United States Patent [19]

Ikeda

[11] 4,135,317

[45] Jan. 23, 1979

[54] SPORTS SHOES EQUIPPED WITH CLEATS

[75] Inventor: Eizo Ikeda, Amagasaki, Japan

[73] Assignee: Mizuno Sporting Goods, Co., Ltd., Osaka, Japan

[21] Appl. No.: 813,327

[22] Filed: Jul. 6, 1977

[30] Foreign Application Priority Data

Jul. 7, 1976 [JP] Japan ..... 51-91016[U]

[51] Int. Cl.[2] ..... A43B 5/00; A43B 23/28

[52] U.S. Cl. ..... 36/134; 36/59 R

[58] Field of Search ..... 36/126, 128, 129, 134, 36/83, 108, 59 R, 67 D, 91, 114

[56] References Cited

U.S. PATENT DOCUMENTS

| | | | |
|---|---|---|---|
| 2,572,680 | 10/1951 | Treat | 36/129 |
| 2,902,780 | 9/1959 | Bellew | 36/134 |
| 3,327,411 | 6/1967 | Roberts | 36/134 |

*Primary Examiner*—Patrick D. Lawson

*Attorney, Agent, or Firm*—Bucknam and Archer

[57] ABSTRACT

Sports shoes are provided with a sole having cleats disposed at such positions that are most suitable from the medical point of view.

1 Claim, 3 Drawing Figures

SPORTS SHOES EQUIPPED WITH CLEATS

This invention relates to sports shoes for baseball, football, rugby, golf, etc., that are equipped with eleven cleats on the sole thereof, and the object of the present invention is to enhance athletic performance in exercises such as walking, running, jumping, etc., and to mitigate fatigue and disorders of the foot and tarsal joints arising from excessive exercise or exercise over extended periods of time, by disposing the cleats at such positions that are most suitable from the medical point of view.

Sports shoes for use in football, rugby and the like have conventionally been provided with a plurality of cleats on the sole thereof. These cleats are positioned on the area of the sole in a substantially regular manner for ease of walking and running as well as for the stability of the shoes. In view of the fact that the cleats are not disposed in consideration of the function and movability of each phalanx and tarsus of the foot, the cleats in the course of excessive excercise or excercise over an extended period of time, the cleats promote aching feet and fatigue of the tarsal joints and lower athletic performance, eventually resulting in disorders of the foot.

A main object of the present invention is to eliminate the above disadvantage encountered in the conventional sports shoes by providing an improvement in sports shoes as a result of a series of experiments conducted from the medical point of view.

An embodiment of the present invention will now be described with reference to the accompanying drawings.

Figure 2:
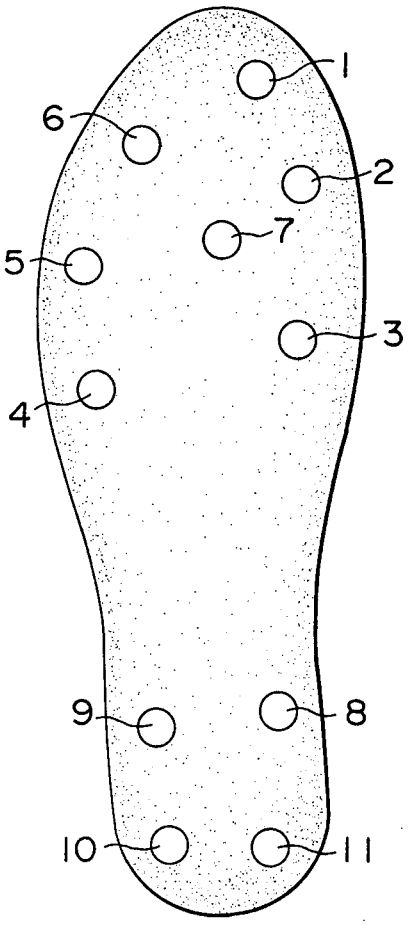
FIG. 2 is a plan view showing a shoe sole equipped with cleats.
Figure 3:
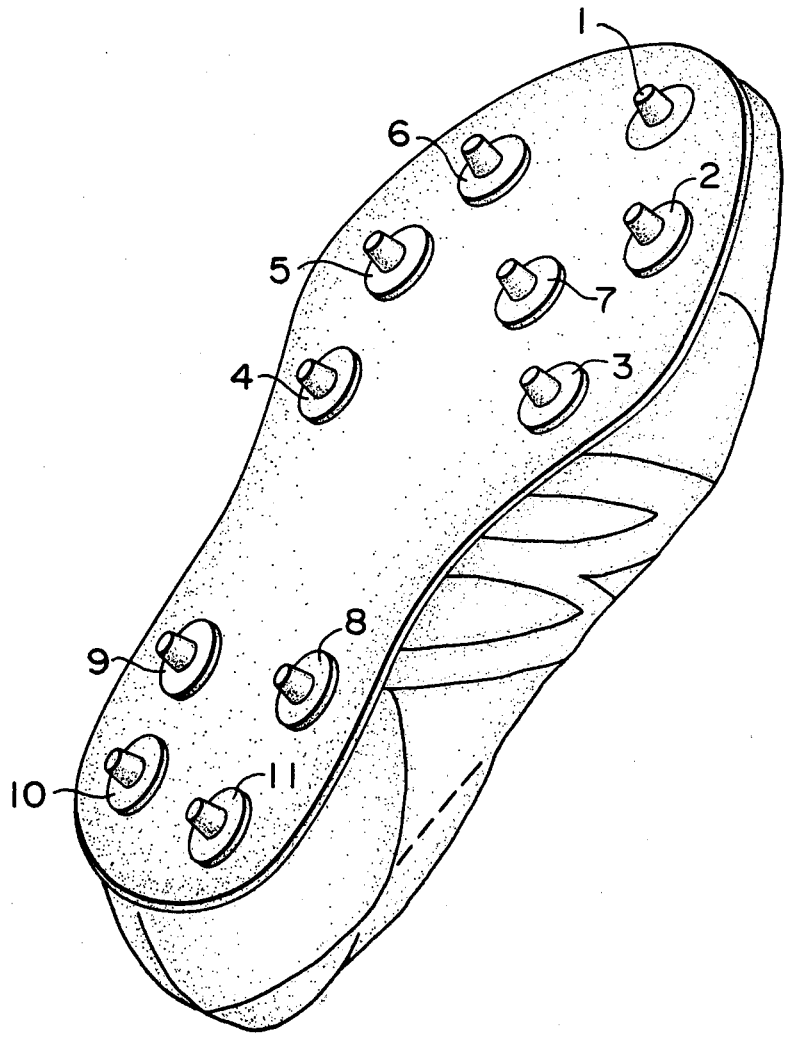
FIG. 3 is a perspective view showing an embodiment of finished shoes.

Referring to the drawings and particularly, to FIGS. 2 and 3 thereof, sports shoes comprise a sole having a plurality of cleats 1 through 10 disposed thereon in accordance with the present invention.

Figure 1:
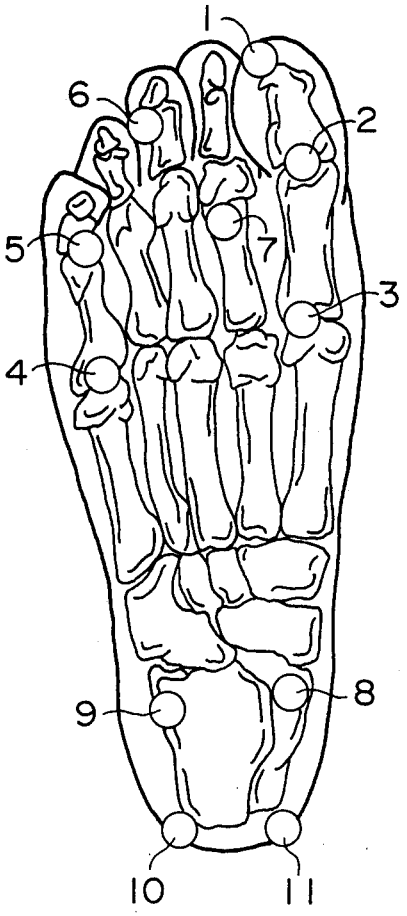
FIG. 1 is a plan view showing the contour of an average foot, skeletal structure and positions of cleats.

The cleat 1 is disposed at the end of the distal phalanx of the first toe as shown in FIG. 1. Propulsive force necessary for the function of the foot arises from the distal phalanx of the hallux, which is the final point of contact with ground in the weight-bearing route of the foot. Therefore, the cleat 1 serves to develop the propulsive force.

The cleat 2 is disposed at the joint connecting the distal phalanx of the first toe to the proximal phalanx thereof. This assists the propulsive force of the foot at the distal phalanx of the hallux.

The cleat 3 is disposed at the joint connecting the proximal phalanx of the first toe to the metatarsus thereof. This is one of the most important positions in the weight-bearing route of the foot and bears about one third of the weight of a human body. Positioning of the cleat serves to prevent a hammer heel which frequently occurs at the capital bone of the metatarsus of the first toe, thereby eliminating pain and acting as a support point in stretching the leg.

The cleat 4 is disposed at the joint connecting the proximal phalanx of the fifth toe to the metatarsus thereof. The line connecting the cleat 3 to the cleat 4 is a line along which the foot bends; hence, this cleat serves to shift the weight-borne by the foot smoothly to the cleat 3.

The cleat 5 is disposed at the joint connecting the middle phalanx of the fifth toe to the proximal phalanx thereof. The length of the proximal phalanx of the first toe is 1.4 times as long as the length of the fifth toe on the average. Hence, the gap between the cleats 4 and 5 is substantially proportional to this ratio relative to the gap between the cleats 2 and 3. This position is important, not for the weight-bearing route of the foot, but for maintaining the forwardly inclined posture of the body. This eliminates the sensation of pain and maintains stability.

The cleat 6 is disposed substantially at the joint connecting the distal phalanx of the third toe and the middle phalanx of the same. The triangle connecting the cleats 6, 3 and 4 forms a substantially equilateral triangle and serves to maintain stability of the body in the forwardly inclined posture.

The cleat 7 is disposed at a position near the capital bone of the proximal phalanx of the second toe. This is a position where intense pain occurs due to fatigue of the foot. The cleat functions to mitigate the degree of pain due to stimulus from the sole surface, and shares the weight borne by cleat 3 along with cleat 2.

The cleat 8 is disposed at the talus in the proximity of the navicular bone away from the sustentaculum talus. In order to facilitate the pivoting of the foot at the heel, this cleat is positioned a little ahead of the other cleats at the heel and in the vicinity of the navicular bone which becomes the center of gravity when one stands upright. This cleat also functions to mitigate pain arising from an upright posture maintained for an extended period of time.

The cleat 9 is disposed at the forward position of the heel bone. The cleats 10 and 11 are positioned at the right and left sections away from the tuber calcanei. They are the first points to make contact with the ground in the weight-bearing route of the foot, and the cleats 8, 9, 10 and 11 maintain stability of the heel and function to mitigate pain in the region of the tuber calcanei.

As described above, the present invention is characterized by disposing each cleat in the particular position. First, considering the weight-bearing route of the foot, the route moves from a point outside the heel along the outer section of the foot to the capital bones of the metatarsussi and terminates at the hallux which provides the major propulsive force at its distal point. This route is expressed in terms ot cleat Nos. 10→9→4→3→2→1, and the foot makes contact with the ground in this order. For this reason, the cleats must be disposed at those positions where painful disorders are not likely to occur. In addition, they should not be located at those positions which hinder propulsive force. In particularly, the disposition of the cleats 4, 3, 2 and 1 is an important medical problem. The position of the cleats 4 and 3 corresponds to the line along which the weight of the body is borne as mentioned above, and also defines a bending section for smoothening functioning of the foot.

Pain imparted by cleats not only hinders the athletic performance of the wearer, but also hastens fatigue of the foot to a marked extent. In order to prevent the pain and smoothen athletic performance, it is preferable to dispose the principal cleats at positions corresponding to the joint of the tarsal phalanges.

The cleats 5, 6, 7, 8 and 11 play an auxiliary role in smoothening the transfer of weight along the weight-bearing route of the foot. They are located at such positions that maintain stability, prevent pain and mitigate fatigue.

The cleat 7 is disposed at a position which gives stimulus to the sole. Application of the stimulus promotes blood circulation and reduces fatigue. The cleat 8 is positioned so as to mitigate pain in the heel even when the wearer stands upright for a long period of time, and especially smoothens the pivoting of the heel.

As explained in detail in the foregoing paragraphs, the cleats in accordance with the present invention are disposed at those positions which exhibit medically significant roles and effects. Hence, the shoes equipped with the cleats of the present invention have excellent athletic function for quick movement forward and back as well as to the right and left, and mitigate pain in the foot and fatigue in joints arising from repetition of excessive exercise, or continuous exercise for an extended period, thereby reducing the occurrence of disorders. Accordingly, the cleats of the present invention are highly effective when applied to sports shoes such as baseball, football, rugby, golf and the like.

I claim:

1. Sports shoes equipped with cleats secured to the sole thereof by screws and the like, which comprises the following disposition of said cleats:

a cleat 1 at the end of the distal phalanx of the first toe;

a cleat 2 at the joint connecting the distal phalanx of the first toe to the proximal phalanx thereof;

a cleat 3 at the joint connecting the proximal phalanx of the first toe to the metatarsus thereof;

a cleat 4 at the joint connecting the proximal phalanx of the fifth toe to the metatarsus thereof;

a cleat 5 at the joint connecting the middle phalanx of the fifth toe to the proximal phalanx thereof;

a cleat 6 substantially at the joint connecting the distal phalanx of the third toe to the middle phalanx thereof;

a cleat 7 at a position near the capital of the proximal phalanx of the second toe;

a cleat 8 under the talus near the navicular bone and away from the sustentaculum tali;

a cleat 9 at a position under the forward of portion the heel bone; and cleats 10 and 11 at positions adjacent the right and left sides of the rearward end of the tuber calcanei respectively.

* * * * *